US008002527B2

(12) United States Patent
Dünn

(10) Patent No.: US 8,002,527 B2
(45) Date of Patent: Aug. 23, 2011

(54) DRY OPERATING SCREW-TYPE COMPRESSOR WITH PNEUMATICALLY CONTROLLED AIR RELIEF VALVE

(75) Inventor: Hans Dünn, Bergisch Gladbach (DE)

(73) Assignee: Dienes Werke Fur Maschinenteile GmbH & Co. (DE)

( * ) Notice: Subject to any disclaimer, the term of this patent is extended or adjusted under 35 U.S.C. 154(b) by 303 days.

(21) Appl. No.: 11/513,335

(22) Filed: Aug. 30, 2006

(65) Prior Publication Data

US 2007/0048147 A1 Mar. 1, 2007

(30) Foreign Application Priority Data

Aug. 30, 2005 (DE) ..... 10 2005 040 921

(51) Int. Cl.
*F04B 49/00* (2006.01)

(52) U.S. Cl. ..... 417/310

(58) Field of Classification Search ..... 417/295, 417/296, 307, 310, 53; 418/201.1, 201.2; 137/614.2, 616.7
See application file for complete search history.

(56) References Cited

U.S. PATENT DOCUMENTS 1,692,773 A * 11/1928 Friedman ..... 137/71
3,367,562 A * 2/1968 Olofsson et al. ..... 417/295
3,860,363 A * 1/1975 Silvern et al. ..... 417/12
3,874,828 A * 4/1975 Herschler et al. ..... 418/87
4,089,623 A * 5/1978 Hofmann, Jr. ..... 417/295
4,147,475 A * 4/1979 Shoop et al. ..... 417/310
4,219,312 A * 8/1980 Mori et al. ..... 417/295
4,968,218 A * 11/1990 Koivula et al. ..... 416/19
5,533,873 A * 7/1996 Kindl ..... 417/295
5,713,724 A * 2/1998 Centers et al. ..... 417/53
5,820,352 A * 10/1998 Gunn et al. ..... 417/53
6,077,051 A * 6/2000 Centers et al. ..... 417/280
6,186,758 B1 * 2/2001 Shaw ..... 418/203
6,450,771 B1 * 9/2002 Centers et al. ..... 417/12
6,715,998 B2 * 4/2004 Virgilio ..... 417/295
2003/0180150 A1 * 9/2003 Nishimura et al. ..... 417/44.2

FOREIGN PATENT DOCUMENTS

JP 02078775 A * 3/1990

* cited by examiner

*Primary Examiner* — Devon C Kramer
*Assistant Examiner* — Amene S Bayou
(74) *Attorney, Agent, or Firm* — Robert Becker; Robert Becker & Assoc.

(57) ABSTRACT

A screw-type compressor having a motor driven and dry operating compressor unit. A butterfly valve is disposed in an intake line connected to the suction side of the compressor unit. An adjustment cylinder mechanically shifts the butterfly valve. A pressure line is connected to the pressure side of the compressor unit and, via the interposition of a check valve, is connected to a compressed air system. The pressure line is connected to a pneumatically controlled air relief valve via an air relief line for relief of pressure during idling of the compressor unit. At least during idling, the air relief valve is adapted to be acted upon by the pressure that is effective on the pressure side of the compressor unit.

15 Claims, 6 Drawing Sheets

Figure 1:
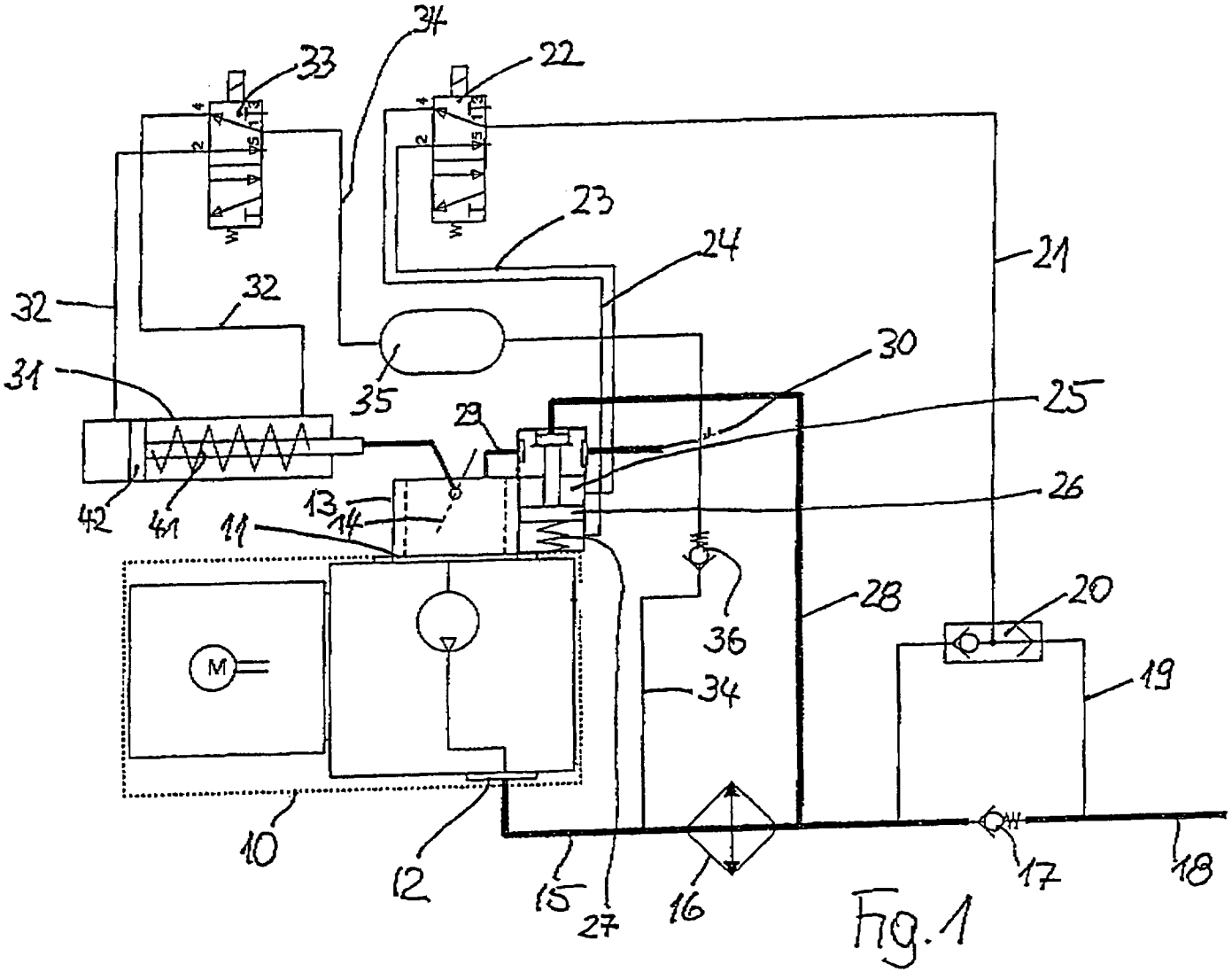

DRY OPERATING SCREW-TYPE COMPRESSOR WITH PNEUMATICALLY CONTROLLED AIR RELIEF VALVE

The instant application should be granted the priority date of Aug. 30, 2005, the filing date of the corresponding German patent application 10 2005 040 921.0.

BACKGROUND OF THE INVENTION

The present invention relates to a screw-type compressor with a motor driven and dry operating compressor unit having a suction side and a pressure side, whereby the suction side is connected to an intake line with a throttle or butterfly valve, which is located inside the intake line and can be displaced mechanically by means of an adjustment cylinder, whereby the pressure side is coupled to an outwardly extending pressure line, which, for the supply of the compressed air, and through the intermediary of a check valve, is connected to a compressed air system, and whereby the pressure line is connected to an air relief valve via an air relief line for the relief of pressure during idling operation of the compressor unit as a result of the butterfly valve being located in a position allowing only a small cross-sectional opening area or as a result of the butterfly valve being located in a completely closed position.

Screw-type compressors in general have the problem that, in the case of a displacement of the butterfly valve into its closed position, depending on the inherently present pressure in the associated compressed air system that is to be supplied, the difference in pressure between the suction side and the pressure side of the compressor unit increases continuously, so that the compression output that is to be performed by the compressor unit increases correspondingly. In screw-type compressors that are configured with an oil-flooded compressor unit, the thereby resulting increased heat is dissipated via the lubricating oil circuit of the compressor unit. In oil-free or, in other words, dry operating compressor units, the pressure side of the compressor unit is relieved, during idling operation of the aforementioned kind, by means of a correspondingly located air relief valve. The development of a difference in pressure is hence prevented so that, during the idling operation, the compressor unit does not work against the inherently present pressure on the pressure side and, hence, no additional heat stress results.

A screw-type compressor of the aforementioned kind is known from use according to the brochure "Stationary oil-free screw-type compressors; the T-series, dual stage, T60Z through T240Z" by ECOAIR from May 1996. In that screw-type compressor, the actuation of the butterfly valve that is located in the intake line is realized by means of an associated adjustment cylinder, which is acted upon by the oil pressure that serves for lubricating the bearing of the compression unit. The provided air relief valve is mechanically coupled to the adjustment cylinder or, respectively, to the displacement of the butterfly valve, resulting in a forced synchronization of the position of the butterfly valve and the opening state of the air relief valve.

Associated with the known structural configuration is the disadvantage that, due to the mechanically realizable surface conditions, the mechanical actuation of the air relief valve requires significantly higher actuating forces and therefore higher oil pressures than necessary or present for the lubrication of the compressor unit. Furthermore, an adaptation of the air relief to single or dual stage compressor units is only possible by using different and distinct mechanical components. Finally, due to the high temperature of the compressed medium, preferably a gas at approximately 200 to 240° Celsius, and therefore the necessity to use specific materials or, respectively, coatings, the expenditure for the manufacturing of the mechanical configuration is correspondingly high.

It is therefore an object of the present application to make the actuation of the air relief valve on a screw-type compressor of the aforementioned kind easier and more expedient.

SUMMARY OF THE INVENTION

The fundamental concept of the invention is that the air relief valve is controlled pneumatically and that it is acted upon, at least during the idling operation of the compressor unit, by the pressure effective on the pressure side of the compressor unit. The invention has the advantage that the inherently present energy on the pressure side of the compressor unit is used to actuate the air relief valve. The mechanical uncoupling of the intake control by the displacement of the butterfly valve on the one hand and the correspondingly necessary air relief by the control of the air relief valve on the other hand results in a higher degree of freedom concerning the configuration of the screw-type compressor. Thus, the mechanical uncoupling enables a proportional regulation of the quantity delivered by the compressor unit, because the control of the air relief valve can be realized independently from the position of the butterfly valve. Furthermore, since the displacement of the butterfly valve is independent from the position of the air relief valve, the requirement for varied idling intake volumes can be met by means of different positions of the butterfly valve. Thus, different configurations for single or, respectively, dual stage compressor units are unnecessary, resulting in a significant cost advantage. Finally, due to the mechanically uncoupled functions of the butterfly valve displacement and the air relief, a more compact configuration of the entire screw-type compressor is possible, which likewise leads to reduced costs and a lower weight per unit. The adjustment cylinders, which are still necessary for the actuation of the butterfly valves, can thereby be dimensioned significantly smaller due to the reduced oil pressure. The use of standard cylinders is sufficient.

If the user of the compressor refrains from using the aforementioned advantage of a proportional regulation of the quantity delivered, a forced pneumatic control between the position of the butterfly valve and the regulation of the air relief valve can be integrated, according to the mechanical solution. Thus, the pneumatically controlled control unit according to the invention becomes compatible without limitation and can even be utilized for replacement on screw-type compressors that are presently being used.

According to one embodiment of the invention, with regard to a proportional regulation of the quantity delivered, the control air connections, which are located in the air relief valve on both sides of a valve piston that is movable in the air relief valve, are connected, through the intermediary of a switching valve that controls the valve piston, to the pressure side of the compressor unit via a control air line. The pressure conditions of the control air with regard to the desired position of the valve piston in the air relief valve can be adjusted by means of the switching valve or an alternatively applicable control valve.

According to one embodiment of the invention, in order to provide sufficient pressure for the control of the valve piston in the air relief valve, the control air line is connected to the pressure line and is provided with a pressure reservoir for maintaining the pressure that is present in the pressure system. Alternatively, a bypass with an included pressure valve, bypassing an intermediary check valve, can be located between the pressure line and the pressure system. Via the pressure valve, which has two switching positions, the bypass connects the control air line either with the pressure line or with the pressure system. In this configuration, depending on the inherently present pressure in the pressure line upstream of the check valve or in the pressure system downstream of the check valve, the respectively higher pressure is utilized for the actuation of the air relief valve.

According to one embodiment of the invention, the adjustment cylinder for the displacement of the butterfly valve can be actuated by means of the oil pressure that acts upon the compressor unit. For this purpose, the adjustment cylinder is connected, via a switching valve and a control oil line, to the lubricating oil circuit for lubricating the bearings of the compressor unit.

As an alternative, it is possible to actuate the adjustment cylinder for the displacement of the butterfly valve pneumatically. For this purpose, the adjustment cylinder for the displacement of the butterfly valve can be operated pneumatically and can be connected, with its control air connections, to the pressure side of the compressor unit via a control air line through the intermediary of a switching valve. In conformity with the alternative possibilities for supplying the air relief valve with control air, the supply of control air for the adjustment cylinder can be realized in that the control air line for the adjustment cylinder is connected to the pressure reservoir, or in that the adjustment cylinder is connected, with its control air connections, in a parallel connection in relation to the air relief valve, to connection lines that extend between the air relief valve and the switching valve for the control air. In the last case, only one switching valve is necessary for the mutual control of the position of the butterfly valve and of the air relief valve, and a mutual switching time is set for the idling operation or, respectively, the operation under load.

According to one embodiment of the invention, a forced pneumatic control between the position of the butterfly valve and the actuation of the air relief valve is possible as well. Therefore, according to one embodiment of the invention, the piston chamber of the air relief valve, which during the idling operation has to be acted upon by pressure in order for the piston to move into its closed position for the air relief line, is connected to the air relief line via a pressurizing line. A pressure relief line having a pressure relief valve is connected to the piston chamber, whereby a forced control between the position of the butterfly valve and the position of the pressure relief valve is effective.

In particular, the pressure relief valve can be located in the area of the hub of the butterfly valve. The pressure relief valve can thereby be configured as at least one opening that is located in the hub of the butterfly valve and that can be opened and closed infinitely, depending on the position of the butterfly valve.

In one embodiment of the invention, the opening is configured as a slot that extends through a part of the perimeter of the hub in an annular manner and is connected to the pressure relief line on the inside. The opening cross-section of the slot can be adjusted by means of an adjusting member that is connected to the butterfly valve and determines the opening cross-section of the slot.

According to one alternative embodiment of the invention, the pressure relief valve can be configured as a notch or recess that is located in the shaft of the butterfly valve and extends from a connection of the pressure relief line located in the area of the hub to the outside of the hub.

According to one embodiment of the invention, the hub is provided with several relief openings.

According to one embodiment of the invention, the air relief valve has two connections for the blow-off air that is to be conducted away. One of the two connections, which can be used selectively, is connected to the intake line, and a muffler for the blow-off air is attached to the other connection. The valve seat for connecting the air relief line to the air relief valve can be configured so as to be pivotable in the air relief valve for the selective use of the connections.

One embodiment of the invention, in particular for screw-type compressors having a forced coupling of the position of the butterfly valve and the position of the air relief valve, is provided with a stop element for the fixation of the end closed position of the butterfly valve. It serves for setting the idling intake volume on single or multi stage screw-type compressors. Due to the arrangement of this stop element, the entire intake and air relief unit can be attached both to single or multi stage screw-type compressors, because by means of the position of the stop unit, the idling intake volume can be changed or set in a simple manner.

Figure 2:
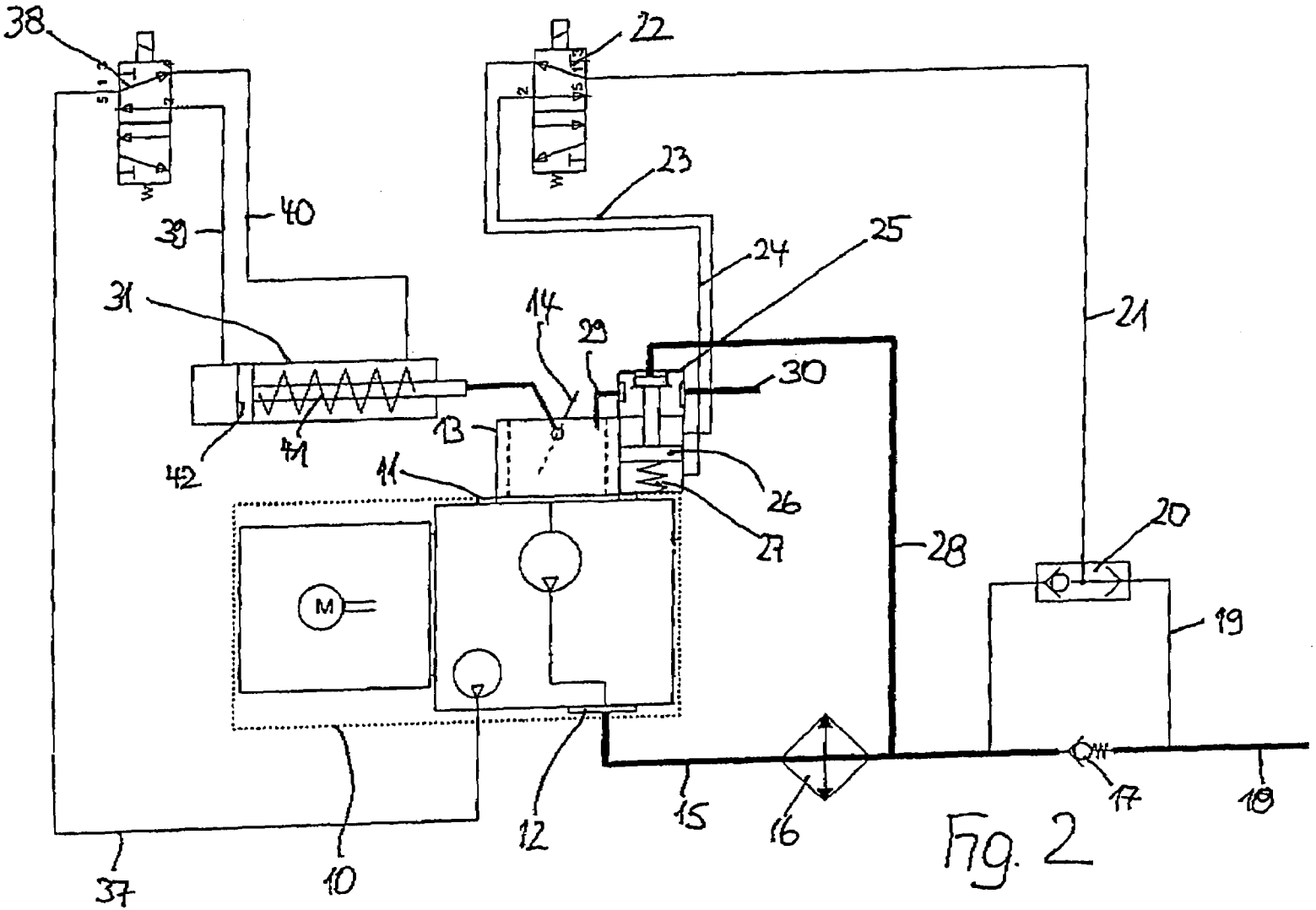
Figure 3:
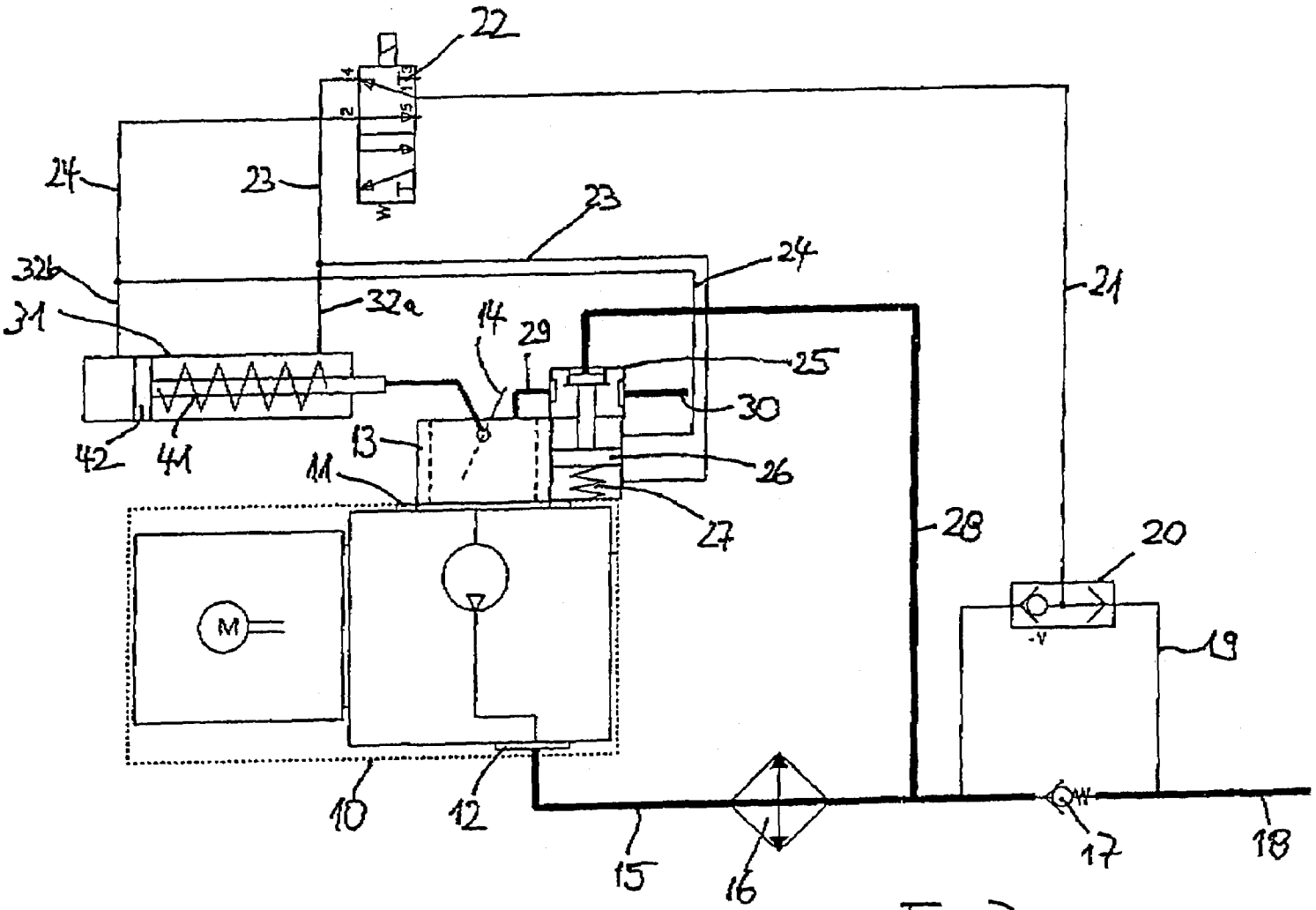
Figure 4:
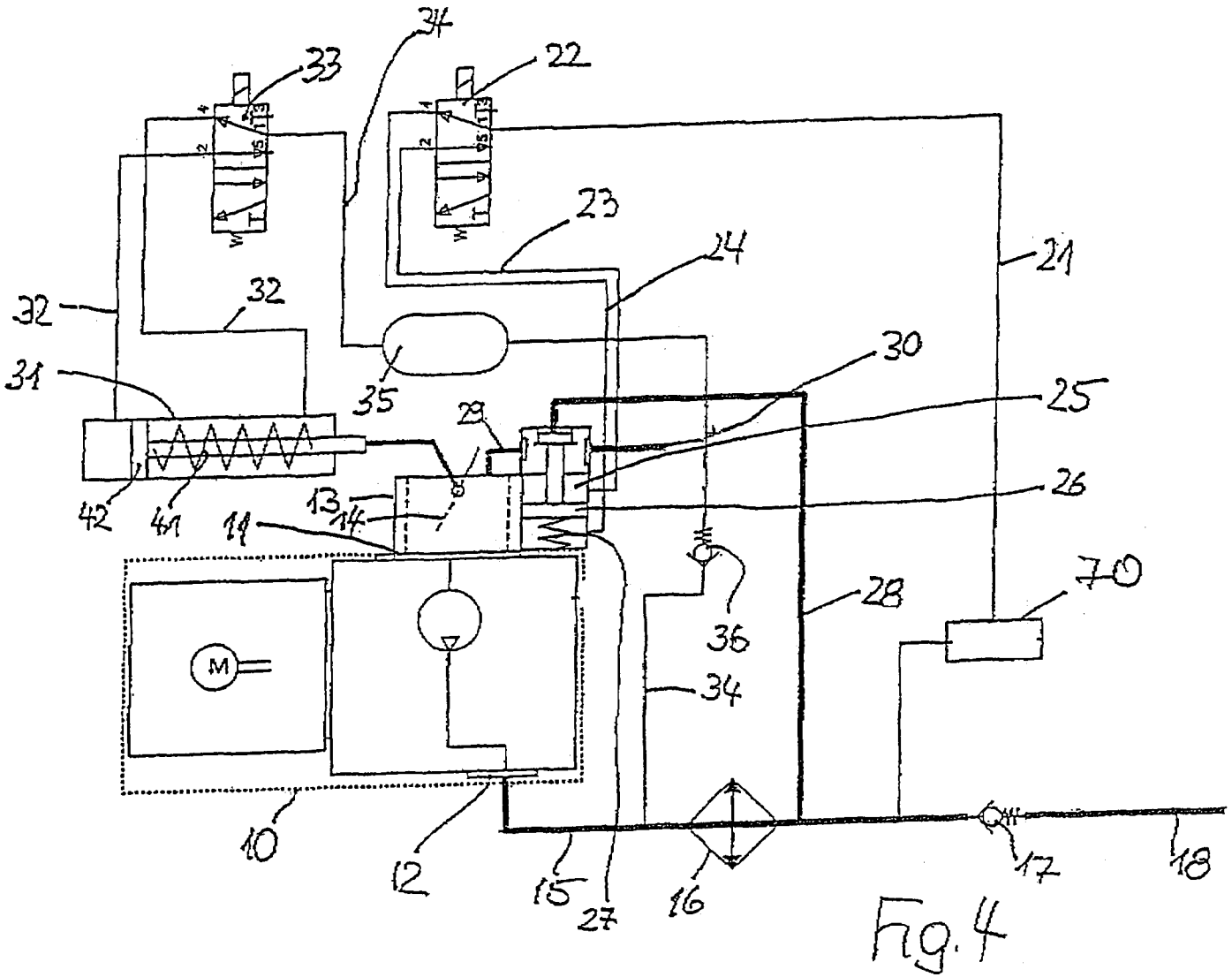
Figure 5:
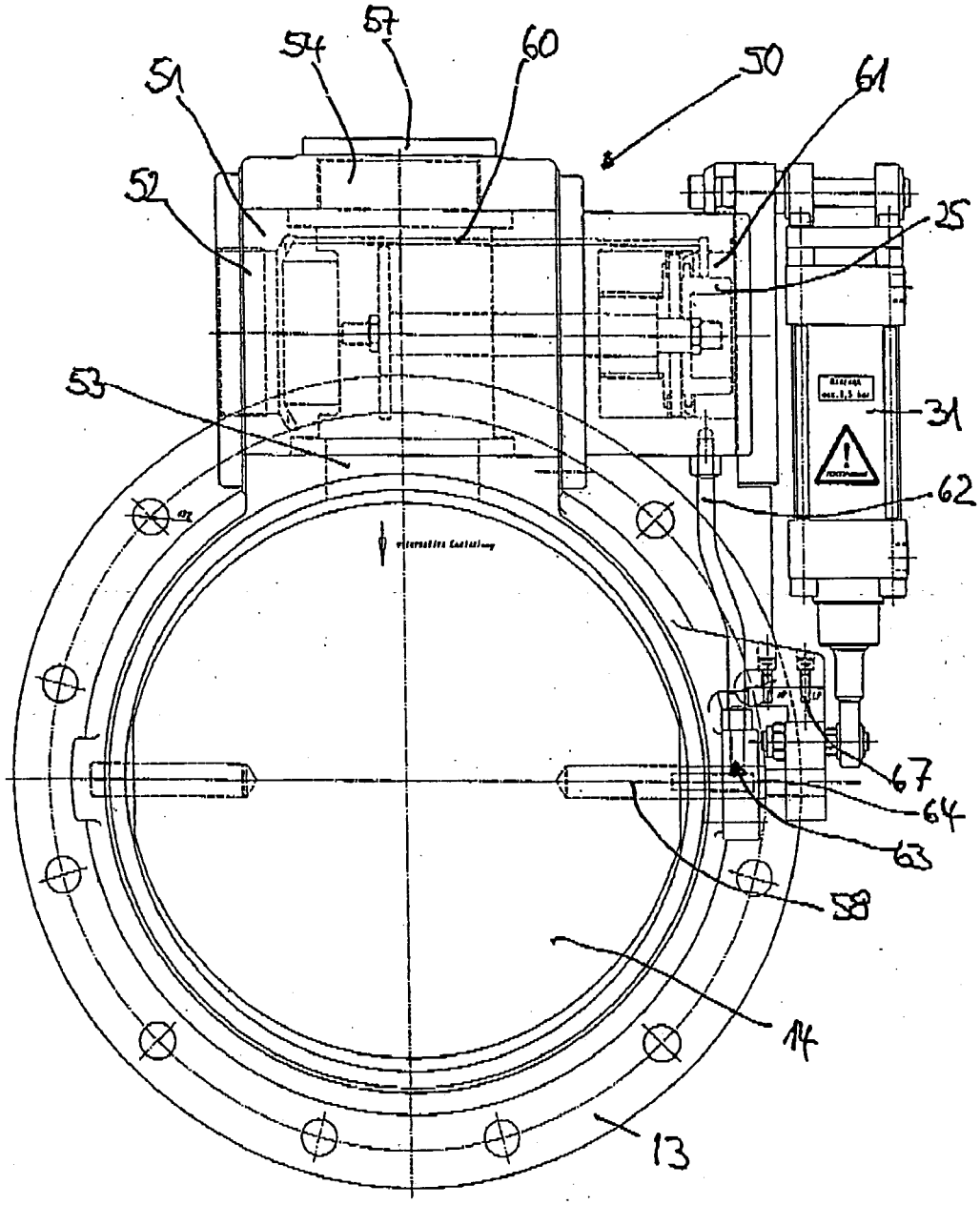
Figure 6:
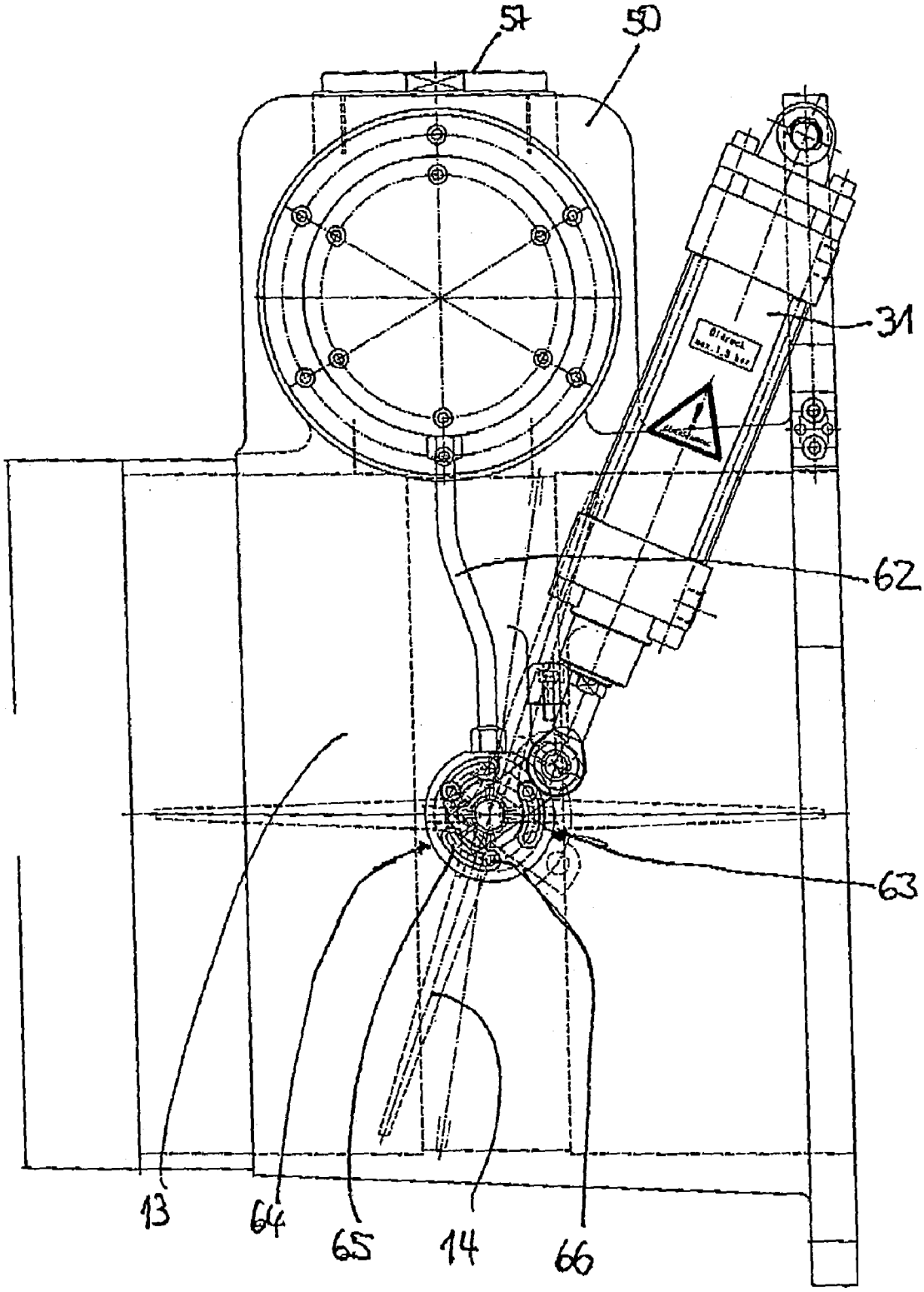

Embodiments of the invention, which are described below, are represented in the drawings, in which:

FIG. 1 shows a circuit diagram for actuating, by means of control air, the adjustment cylinder that controls the butterfly valve and the air relief valve for a proportional regulation of the quantity delivered, FIG. 2 shows the circuit diagram according to FIG. 1, whereby the adjustment cylinder is connected to the lubricating oil circuit of the compressor unit, FIG. 3 shows a circuit diagram for actuating, by means of control air, the adjustment cylinder for the control of the butterfly valve with a common switching location for the load position and the idling position of the butterfly valve and the air relief valve, FIG. 4 shows an air relief valve in a configuration for a proportional regulation of the quantity delivered in a partially sectioned front view, FIG. 5 shows the air relief valve according to FIG. 4 in a configuration with a forced coupling between the position of the butterfly valve and the control of the air relief valve, and FIG. 6 shows the subject matter according to FIG. 5 in a side view.

DESCRIPTION OF SPECIFIC EMBODIMENTS

The configuration of the screw-type compressor according to the invention is first described for different embodiments with the aid of the circuit diagrams represented in FIGS. 1 through 3, which show the association of the connections or, respectively, the connecting lines.

A compressor unit 10 with a drive motor has a suction side 11 and a pressure side 12. On its suction side 11, the compressor unit 10 is connected to an intake line 13 in which a butterfly valve 14 is located so as to be displaceable into different opening positions. On its pressure side 12, a pressure line 15 extends away from the compressor unit 10 and through an intermediate cooler or intercooler 16 and a back-pressure or check valve 17. After the check valve 17, the pressure line 15 is connected to the compressed air system 18, into which the compressed air is to be introduced. In the embodiment represented here, an air relief line 28, disposed downstream of the intercooler 16, extends away from the pressure line 15. The air relief line 28 enables the relief of pressure on the pressure side 12 during the idling operation of the compressor unit 10 and is connected to an air relief valve 25, which is structurally integrated into the compressor unit 10.

The pneumatically operated air relief valve 25 is integrated into a control circuit in the following manner: The air relief valve 25 has a valve piston 26 that is acted upon by a spring 27 and serves for closing the inlet of the air relief line 28 into the air relief valve 25. Connected on both sides of the valve piston 26 are corresponding connection lines 23 and 24 that serve as control air connections and extend to a switching valve 22, which in turn is supplied by a control air line 21. The control air line 21 extends to a pressure valve 20 that is disposed in a bypass 19, which by-passes the check valve 17 that is located between the pressure line 15 and the pressure system 18. Due to this configuration, the pressure present in the control air line 21 is always equal either to the pressure present in the pressure line 15 or, respectively, in the pressure system 18, depending on which pressure is higher.

The air relief valve 25 has an outlet 30, which releases, in an advantageous manner via a not represented sound absorber or muffler, the blow off air into the atmosphere. The air relief valve 25 furthermore has a second outlet 29 that is connected to the intake line 13 so that, alternatively, the blow off air that is conveyed through the outlet 29 of the air relief valve 25 can be released into the intake line 13 and hence kept in the circuit.

In order to be displaceable, the butterfly valve 14 is mechanically connected to an adjustment cylinder 31, which, in the embodiment represented here, is likewise actuated pneumatically. For this purpose, connection lines 32*a, b* are connected to the adjustment cylinder 31 in a known manner. The connection lines 32*a, b* both lead to a switching valve 33 that is connected to a control air line 34. The control air line 34 extends, via a pressure reservoir 35 and a back-pressure or check valve 36, to the pressure line 15 and, in the embodiment represented here, is connected to the pressure line 15, relative to the direction of flow, upstream of the intercooler 16.

According to the represented circuit diagram, a proportional regulation of the quantity delivered is possible because both the adjustment cylinder 31 and the air relief valve 25, respectively, can be controlled independently since they are connected to separate control air supplies. In order to displace the butterfly valve 14 into its closed position, control air that flows through the pressure line 15 acts upon the adjustment cylinder 31, corresponding to the position of the switching valve 33. The built in pressure reservoir 35 thereby ensures that—even in the case of a decrease in pressure in the pressure line 15—a sufficient amount of pressure for the displacement of the butterfly valve 14 is available.

Regardless of that, the air relief valve 25 can be acted upon via the control air line 21 and the switching valve 22. The air relief valve 25 opens the air relief line 28 to the desired extent so that the pressure in the pressure line 15 is relieved, associated with an increasingly closed position of the butterfly valve 14. If the compressor unit 10 is to be operated under load again, the butterfly valve 14 is opened by means of control air and, simultaneously, the air relief valve 25 closes the air relief line 28.

The embodiment represented in FIG. 2 differs from the embodiment represented in FIG. 1 in that the adjustment cylinder 31 is actuated by the oil pressure of the lubricating oil circuit that serves for lubricating the bearings of the compressor unit 10. For this purpose, a control oil line 37 extends from the compressor unit 10 to a switching valve 38. Connection lines 39 and 40 extend from the switching valve 38 to the adjustment cylinder 31 and are each connected to one of the two pressure chambers of the adjustment cylinder. A valve spring 41 acts upon the piston 42 that separates the two pressure chambers. The control of the air relief valve thereby remains unchanged.

In the embodiment represented in FIG. 3 both the adjustment cylinder 31 and the air relief valve 25 are again operated pneumatically, whereby only a single switching valve 22 is provided, which, in a single switching time, switches both the adjustment cylinder 31 and the air relief valve 25 into the idling position or, respectively, into the load position. The supply of control air via the control air line 21 to the switching valve 22 is therefore realized as described in accordance with FIG. 1. Likewise, the connection of the air relief valve 25 to the switching valve 22 via the connection lines 23, 24 is unchanged.

The pneumatically operated adjustment cylinder 31 with its control air lines 32*a, b*, however, is now connected, in a parallel connection in relation to the air relief valve 25, to the connection lines 23, 24 and therefore to the switching valve 22. If the switching valve 22 switches to the idling position, the adjustment cylinder 31 is simultaneously forced to close the butterfly valve 14, and the air relief line 28 in the air relief valve 25 is opened. The blow off air that flows into the air relief line 28 due to the relief of pressure in the pressure line 15 flows off either via the outlet 29 into the intake line 13 or via the outlet 30 and via the muffler, depending on the setting of the connection. When switched to the load position, the butterfly valve 14 is opened and the air relief valve 25 is closed.

FIG. 4 shows a structural configuration of a pneumatically operated air relief valve that is attached to the compressor unit 10 or, respectively, to the intake line 13 in accordance with the representation in FIGS. 1 through 3. The butterfly valve 14 is located in the intake line 13 so as to be pivotable. The air relief valve 50 has a valve seat 51 with a connection 52 for the air relief line 28. Furthermore, the air relief valve 50 has a connection 53 that extends into the intake line 13 and alternatively a connection 54 for an exhaust air line that leads to a muffler. In the embodiment represented here, a lid 57 covers the connection 54. The air relief valve 50 has, in accordance with the representation in FIGS. 1 through 3, a piston chamber 55 in which the valve piston 26 of the air relief valve 50 is movable. The connections 56 for the connection lines 23, 24 are indicated in the two parts of the piston chamber 55 that are separated by the valve piston 26. The reference numeral 23 indicates the connection for the connection line that is acted upon by pressure during the idling operation; when the control air acts upon it, the valve piston 26 is moved to the right and therefore opens the valve seat 51 for the inflow of exhaust air through the connection 52. When the connection line 24 is acted upon by pressure, the valve piston 26 is moved to the left into its closing position. The arrangement of an adjustment cylinder 31 and its connection to the shaft 58 of the butterfly valve 14 is only represented schematically. In the embodiment represented here, the adjustment cylinder 31 is acted upon by means of control oil.

The embodiment represented in FIGS. 5 and 6 shows a forced pneumatic control between the position of the butterfly valve and the actuation of the air relief valve. Hence, the piston chamber 61, which has to be acted upon by pressure in order to move the valve piston to the left into its closing position, is constantly connected to the air relief line 28 via a pressurizing line 60 that is located on the inside. Consequently, the pressure that is present in the piston chamber 61 is always equal to the pressure on the pressure side 12 of the compressor unit 10. When the butterfly valve 14 is open, that pressure keeps the valve piston 26 in a closing position with regard to the connection 52 for the air relief line 28. A pressure relief line 62 extends from the piston chamber 61 that is acted upon by pressure to a pressure relief valve 63, which, depending on the position of the butterfly valve 14 in the intake line 13, can be opened and closed. In the area of the hub 64, the shaft 58 of the butterfly valve 14 can hereby be provided with a recess that extends from a connection of the pressure relief line 62 to the outside of the hub 64 so that a control edge is formed in the transition between the connection of the pressure relief line and the recess. The switching time for the release of the air relief valve can be set or adjusted by means of the position or, respectively, the adjustment, of the control edge.

If the butterfly valve is displaced from the open position into the closed position, which is represented in FIGS. 5 and 6, the pressure relief opening that is connected to the pressure relief line 62 is opened simultaneously so that the pressure that acts upon the pressurizing line 60 can escape from the piston chamber 61. Hence, the pressure present in the piston chamber 61 is no longer sufficient for keeping the piston 26 in its closed position, so that the closing of the butterfly valve 14 brings about the opening of the connection 52 for the air relief line 28. Depending on the position of the butterfly valve 14, the connection 52 is opened more or less so that a direct coupling between the position of the butterfly valve 14 and the position of the air relief valve 50 is realized. Due to the adjustable stop 67 for positioning the butterfly valve 14 at the desired idling volume, the entire intake and air relief unit can be attached, in a simple manner, to either single or multi stage screw-type compressors. This is because by means of the stop 67, the end closing position of the butterfly valve 14 and therefore the idling intake volume can be adjusted according to the configuration of the compressor.

The features of the subject matter of these documents, disclosed in the above description, in the patent claims, in the summary and in the drawing, can be essential separately or in any combination with each other for the implementation of the various embodiments of the invention.

The specification incorporates by reference the disclosure of German priority document 10 2005 040 921.0 filed 30 Aug. 2005.

The present invention is, of course, in no way restricted to the specific disclosure of the specification and drawings, but also encompasses any modifications within the scope of the appended claims.

What I claim is:

1. A screw-type compressor, comprising:

a motor driven and dry operating compressor unit that has a suction side and a pressure side;

a butterfly valve disposed in an intake line connected to said suction side of said compressor unit;

an adjustment cylinder that is adapted to mechanically shift said butterfly valve;

a pressure line connected to said pressure side of said compressor unit, wherein said pressure line, via the interposition of a check valve, is adapted to be connected to a compressed air system for a supply of compressed air thereto; and a pneumatically controlled air relief valve, wherein said pressure line is connected to said air relief valve via an air relief line for a relief of pressure during idling of said compressor unit, and wherein at least during idling of said compressor unit said air relief valve is adapted to be acted upon by the pressure that is effective on said pressure side of said compressor unit, wherein a valve piston is movably disposed in said air relief valve, wherein control air connections are provided in said air relief valve on opposite sides of said valve piston, wherein a first switching valve that controls said valve piston is connected to said control air connections, and wherein a control air line connects said first switching valve to said pressure side of said compressor unit, and wherein the control air line are always connected with the pressure side of the compressor unit, so that said valve piston is moved by the pressure existing on the pressure side of the compressor unit, wherein a bypass is disposed between said pressure line and the compressed air system, wherein said bypass bypasses said check valve, wherein a pressure valve that has two positions is disposed in said bypass, and wherein said control air line is connected via said pressure valve either with said pressure line or with the compressed air system, so that depending on an inherently present pressure in the pressure line upstream of the check valve or in a pressure system downstream of the check valve, the respectively higher pressure is utilized for actuation of the air relief valve, and wherein the butterfly valve and the air relief valve are configured to be controlled independently of one another via respective drives for adjustment of a consumption-dependent position of the butterfly valve and for proportional regulation of a quantity delivered by the compressor.

2. A screw-type compressor according to claim 1, wherein said control air line is connected to said pressure line, and wherein a pressure reservoir, for maintaining a pressure present in the compressed air system, is provided in said control air line.

3. A screw-type compressor according to claim 1, wherein for adjustment of said butterfly valve, said adjustment cylinder is connected via a switching valve and a control oil line to a lubricating oil circuit provided for lubrication of bearings of said compressor unit.

4. A screw-type compressor according to claim 1, wherein said adjustment cylinder is adapted to be operated pneumatically and is provided with further control air connections, wherein a second switching valve is connected to said further control air connections, and wherein a further control air line is provided that connects said second switching valve to said pressure side of said compressor unit.

5. A screw-type compressor according to claim 4, wherein said further control air line for said adjustment cylinder is connected to a pressure reservoir.

6. A screw-type compressor according to claim 4, wherein connection lines extend between said air relief valve and said switching valve for control air, and wherein said adjustment cylinder is connected with its control air connections, in a parallel connection relative to said air relief valve, to said connection lines.

7. A screw-type compressor, comprising:

a motor driven and dry operating compressor unit that has a suction side and a pressure side;

a butterfly valve disposed in an intake line connected to said suction side of said compressor unit;

an adjustment cylinder that is adapted to mechanically shift said butterfly valve;

a pressure line connected to said pressure side of said compressor unit, wherein said pressure line, via the interposition of a check valve, is adapted to be connected to a compressed air system for a supply of compressed air thereto; and a pneumatically controlled air relief valve, wherein said pressure line is connected to said air relief valve via an air relief line for a relief of pressure during idling of said compressor unit, and wherein at least during idling of said compressor unit said air relief valve is adapted to be acted upon by the pressure that is effective on said pressure side of said compressor unit, wherein a valve piston is disposed in said air relief valve, wherein during idling operation a piston chamber of said air relief valve is adapted to be acted upon with pressure for shifting said valve piston into a closed position for said air relief line, wherein a pressurizing line is provided and connects said piston chamber of said air relief valve to said air relief line, wherein a pressure relief line having a pressure relief valve is connected to said piston chamber, and wherein a forced control is established between the position of said butterfly valve and the position of said pressure relief valve.

8. A screw-type compressor according to claim 7, wherein said pressure relief valve is disposed in the vicinity of a hub of said butterfly valve.

9. A screw-type compressor according to claim 8, wherein said pressure relief valve is embodied as at least one opening that is disposed in said hub of said butterfly valve and is adapted to be opened and closed in an infinitely variable manner as a function of the position of said butterfly valve.

10. A screw-type compressor according to claim 9, wherein said opening is embodied as a slot that extends over a portion of the periphery of said hub and is internally connected with said pressure relief line, and wherein said slot has an opening cross-section that is adapted to be adjusted by an adjusting member that is connected to said butterfly valve and determines said opening cross-section of said slot.

11. A screw-type compressor according to claim 8, wherein said pressure relief valve comprises a recess that is disposed in a shaft of said butterfly valve and extends from a connection of said pressure relief line in the vicinity of said hub to externally of said hub.

12. A screw-type compressor according to claim 8, wherein a plurality of pressure relief openings are formed on said hub.

13. A screw-type compressor according to claim 7, wherein said air relief valve has two, selectively usable connections for blow-off air that is to be conducted away, wherein one of said connections is connected with said intake line, and wherein the other connection is connected to a muffler for the blow-off air.

14. A screw-type compressor according to claim 13, wherein a valve seat for a connection of said air relief line to said air relief valve is rotatable in said air relief valve for said selective use of said connections.

15. A screw-type compressor according to claim 7, wherein a stop element is provided for a fixation of an end closed position of said butterfly valve for setting an idling intake volume for single or multi stage screw-type compressors.

* * * * *